US009590299B2

(12) United States Patent
Rao et al.

(10) Patent No.: US 9,590,299 B2
(45) Date of Patent: Mar. 7, 2017

(54) INTEGRATED ANTENNA AND RF PAYLOAD FOR LOW-COST INTER-SATELLITE LINKS USING SUPER-ELLIPTICAL ANTENNA APERTURE WITH SINGLE AXIS GIMBAL

(71) Applicant: NORTHROP GRUMMAN SYSTEMS CORPORATION, Falls Church, VA (US)

(72) Inventors: Sudhakar K. Rao, Rancho Palos Verdes, CA (US); Daniel H. Roper, Torrance, CA (US); Alan M. Taft, Torrance, CA (US); Sebong Chun, Orange, CA (US); Christopher S. Brown, Torrance, CA (US); Mansoor K. Siddique, Torrance, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 32 days.

(21) Appl. No.: 14/739,540

(22) Filed: Jun. 15, 2015

(65) Prior Publication Data

US 2016/0365630 A1 Dec. 15, 2016

(51) Int. Cl.

| | |
|---|---|
| ***H01Q 3/12*** | (2006.01) |
| ***H01Q 3/20*** | (2006.01) |
| ***H01Q 19/13*** | (2006.01) |
| ***H01Q 1/28*** | (2006.01) |
| ***H01Q 3/06*** | (2006.01) |
| ***H01Q 19/19*** | (2006.01) |

(52) U.S. Cl.

CPC ..... *H01Q 3/20* (2013.01); *H01Q 1/288* (2013.01); *H01Q 3/06* (2013.01); *H01Q 19/132* (2013.01); *H01Q 19/193* (2013.01); *H01Q 19/134* (2013.01)

(58) Field of Classification Search

CPC ..... H01Q 19/13
USPC ..... 343/761, 766, 356
See application file for complete search history.

(56) References Cited

U.S. PATENT DOCUMENTS 4,408,209 A 10/1983 Urien et al.
4,656,484 A 4/1987 Brown et al.
(Continued)

OTHER PUBLICATIONS

Anonymous, "Iridium Satellite Constellation" Wikipedia, the free encyclopedia, May 20, 2015, pp. 1-5.
(Continued)

*Primary Examiner* — Jean B Jeanglaude
(74) *Attorney, Agent, or Firm* — John A. Miller; Miller IP Group, PLC

(57) ABSTRACT

A dual-reflector inter-satellite link (ISL) subsystem, for a communications satellite in a constellation of satellites in low earth orbit or medium earth orbit. The ISL subsystem includes a main antenna reflector which uses a single-axis gimbal to steer the main reflector only in the elevation plane. An antenna subreflector, a horn and RF feed circuitry are stationary with respect to the host satellite. The main reflector has a super-elliptical design which provides a beam shape which requires no steering in the azimuth plane, while meeting ISL signal strength requirements. By steering the main reflector only, and only in the elevation plane, the disclosed ISL subsystem delivers significantly lower size, mass, complexity and cost, and significantly greater reliability, than traditional ISL systems.

20 Claims, 6 Drawing Sheets

(56) References Cited

U.S. PATENT DOCUMENTS

| | | | | |
|---|---|---|---|---|
| 5,977,923 | A | 11/1999 | Contu et al. | |
| 6,043,788 | A | 3/2000 | Seavey | |
| 6,204,822 | B1 | 3/2001 | Cardiasmenos et al. | |
| 6,239,763 | B1 | 5/2001 | Cuchanski | |
| 6,262,689 | B1 | 7/2001 | Yamamoto et al. | |
| 6,285,338 | B1 | 9/2001 | Bai et al. | |
| 6,486,845 | B2 | 11/2002 | Ogawa et al. | |
| 6,522,305 | B2 | 2/2003 | Sharman | |
| 6,628,238 | B2 | 9/2003 | Ramanujam et al. | |
| 6,771,225 | B2 | 8/2004 | Tits | |
| 7,710,340 | B2 | 5/2010 | Rao et al. | |
| 7,786,945 | B2 | 8/2010 | Baldauf et al. | |
| 8,248,298 | B2 | 8/2012 | Lalezari | |
| 8,354,956 | B2 | 1/2013 | Matyas et al. | |
| 8,913,894 | B2 | 12/2014 | Coleman et al. | |
| 2003/0122723 | A1* | 7/2003 | Luly | H01Q 19/132 343/781 P |
| 2006/0097940 | A1* | 5/2006 | Shimawaki | H01Q 3/26 343/761 |
| 2010/0238082 | A1* | 9/2010 | Kits van Heyningen | H01Q 3/08 343/761 |
| 2011/0068972 | A1* | 3/2011 | McCandliss | H04B 7/19 342/356 |
| 2012/0013515 | A1* | 1/2012 | Berejik | H01Q 1/125 343/766 |
| 2013/0307719 | A1* | 11/2013 | Granet | G01S 13/4409 342/153 |

OTHER PUBLICATIONS

Rao, Sudhakar, et al. "Handbook of Reflector Antennas and Feed Systems Volume III" Chapter 7, titled Feed Assemblies, Passive Intermodulation, Multipaction, and Corona, Jan. 1, 2013, pp. 279-289, sections 7.2.5-7.4-7.15.

Martinez, Ramon, et al. "Iterative Synthesis of Dual-Shaped Reflectors with Superelliptical Apertures" Antennas and Propagation Society International Symposium, IEEE 2006, Jul. 9-14, 2006. pp. 2447-2450.

Iverson, D. "Co-Ordinate Transformations for Antennas with Reflectors" Electronics Letters, vol. 36, No. 5, Mar. 2, 2000, pp. 458-459.

General Electric, "60 GHz Antenna System Analyses for Intersatelfite Links, Phase A—Final Report" Document No. 84SDS4255, Jun. 6, 1984, pp. 1-141.

Huy, Nguyen Manh, et al. "Avalon Satellite System" HUS High School of Mathematics and Science, Singapore Space Challenge, May 5, 2009, 95 pgs.

Debruin, James, "Control Systems for Mobile Satcom Antennas" Establishing and Maintaining High-Bandwidth Satellite Links During Vehicle Motion, IEEE Control Systems Magazine, Feb. 2008, pp. 86-101.

Kumar, Chandrakanta, "Axially Displaced Ellipse Reflector Antenna for Chandrayaan-1 Data Transmission System" Communication Systems Group, India, 4 pgs.

* cited by examiner

INTEGRATED ANTENNA AND RF PAYLOAD FOR LOW-COST INTER-SATELLITE LINKS USING SUPER-ELLIPTICAL ANTENNA APERTURE WITH SINGLE AXIS GIMBAL

BACKGROUND

Field

This invention relates generally to an antenna subsystem for a communications satellite and, more particularly, to an integrated antenna and RF payload for inter-satellite link communication including a main antenna reflector having a super-elliptical shape and a subreflector, where the subreflector and feed assembly are fixed in position to the satellite, and the main reflector has a single-axis gimbal mount for aiming adjustment in the elevation direction and a wide beam which precludes the need for aiming adjustment in the azimuth direction.

Discussion

Communications satellites are used to enable many different types of telecommunications. For fixed (point-to-point) services, communications satellites provide a microwave radio relay technology which is complementary to that of communication cables. Communications satellites are also used for mobile applications such as communications to ships, vehicles, planes and hand-held terminals, and for TV and radio broadcasting.

In one common implementation, a constellation including dozens of communications satellites are placed in low earth orbit (LEO) or medium earth orbit (MEO) in a constellation which circles the earth. The individual satellites in the constellation communicate with each other, and also communicate with users and communications providers on or near the earth's surface. The communications among the satellites in the constellation are handled by what are known as inter-satellite links (ISL).

There are many factors which provide motivation for cost reduction, mass reduction and simplification in communications satellites—and in the ISL subsystem in particular. These factors include the large number of satellites required in LEO or MEO constellations, the high cost of launching satellites in general and the dramatic effect of mass on cost, and the need for extreme levels of reliability. As a result of all of these factors, there is a need for an ISL subsystem with lower cost, lower mass and simpler operation than ISL subsystems currently used on communications satellites.

DETAILED DESCRIPTION OF THE EMBODIMENTS

The following discussion of the embodiments of the invention directed to an inter-satellite link (ISL) antenna subsystem is merely exemplary in nature, and is in no way intended to limit the invention or its applications or uses. For example, the embodiments discussed below are described in the context of communications satellites in low earth orbit or medium earth orbit. However, the disclosed ISL subsystem may also be suitable for use in other types of satellites or other types of orbits.

Figure 1A:
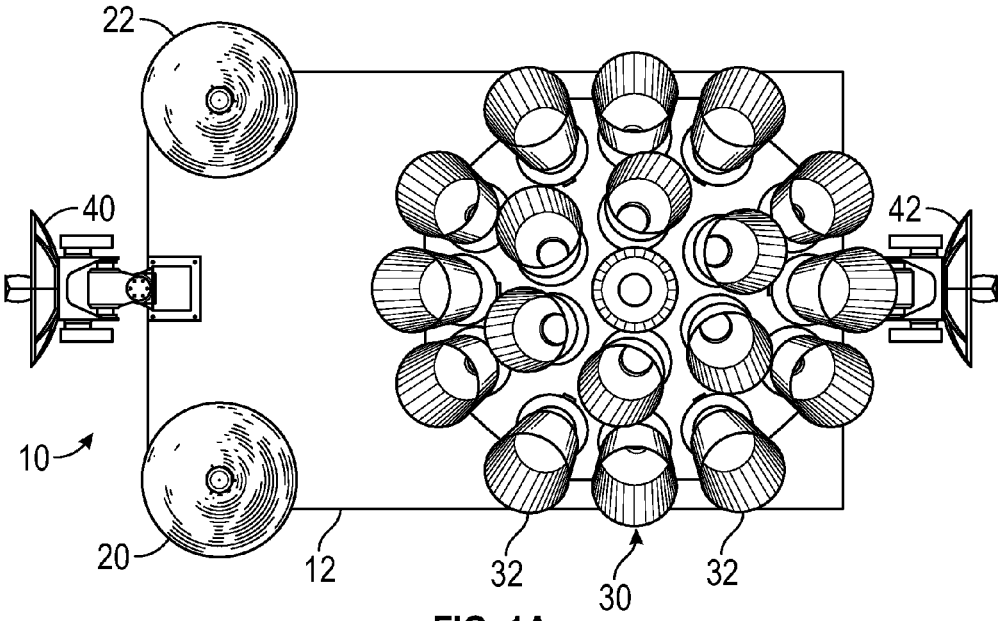
FIG. 1A (Prior Art)
FIGS. 1*a* and 1*b* are bottom view and side view illustrations, respectively, of a communications satellite, showing user link and gateway communications antennas and forward-looking and rearward-looking inter-satellite link (ISL) subsystems.
Figure 1B:
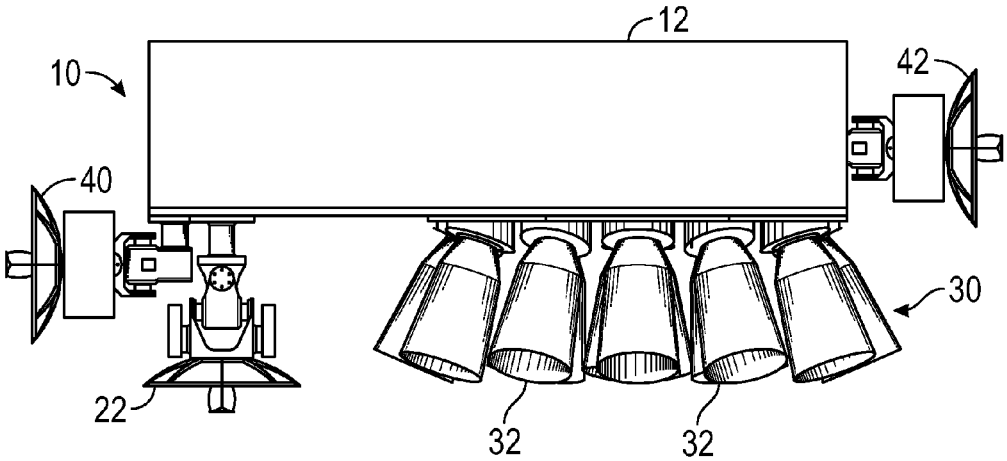
FIG. 1B (Prior Art)

FIGS. 1*a* and 1*b* are bottom view and side view illustrations, respectively, of a communications satellite 10. The communications satellite 10 is one satellite in a constellation of satellites circling in a low earth orbit (LEO) or a medium earth orbit (MEO). The communications satellite 10 includes gateways 20 and 22, which are used for communications between the satellite 10 and telecommunications companies on earth such as television or mobile phone service providers. The communications satellite 10 also includes a user link array 30, typically comprising a number of narrowly-focused transmit-receive antennas 32. The user link array 30 handles communications between the satellite 10 and individual users and service subscribers on earth.

The communications satellite 10 further includes inter-satellite links (ISL) 40 and 42. The ISLs 40 and 42 are used for communications with other satellites in the constellation, where the ISL 40 may communicate with a leading satellite and the ISL 42 may communicate with a trailing satellite in the LEO or MEO constellation. In FIGS. 1*a* and 1*b*—the gateways 20/22, the user link array 30 and the ISLs 40/42 are all shown as being mounted directly to a chassis 12—although different configurations are possible. In order to minimize transmission power requirements, it is necessary for the ISLs 40 and 42 to accurately track the position of the leading and trailing satellites. At the same time, it is desirable to minimize the cost, mass and complexity of the ISLs 40 and 42 in order to reduce launch costs and increase service life of the satellite 10. The need for cost, mass and complexity reduction in the ISLs 40 and 42 is especially apparent when considering that dozens or hundreds of the satellites 10 are required in the constellation.

Figure 2:
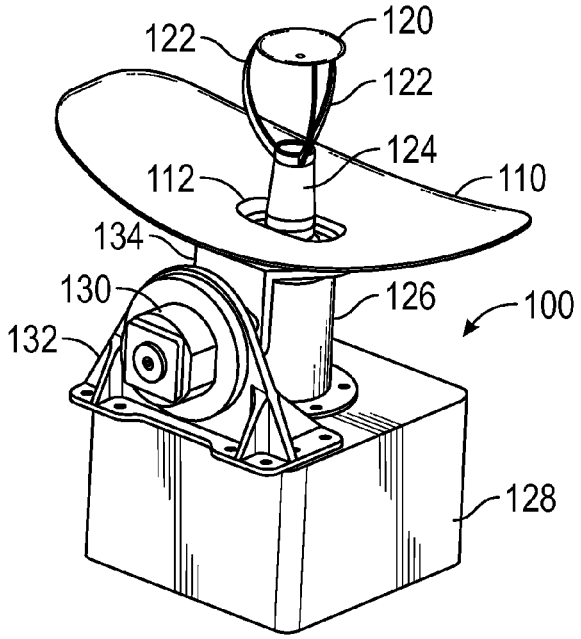
FIGS. 2 and 3 are two different isometric view illustrations of an ISL subsystem which provides many advantages over traditional ISL systems.
Figure 3:
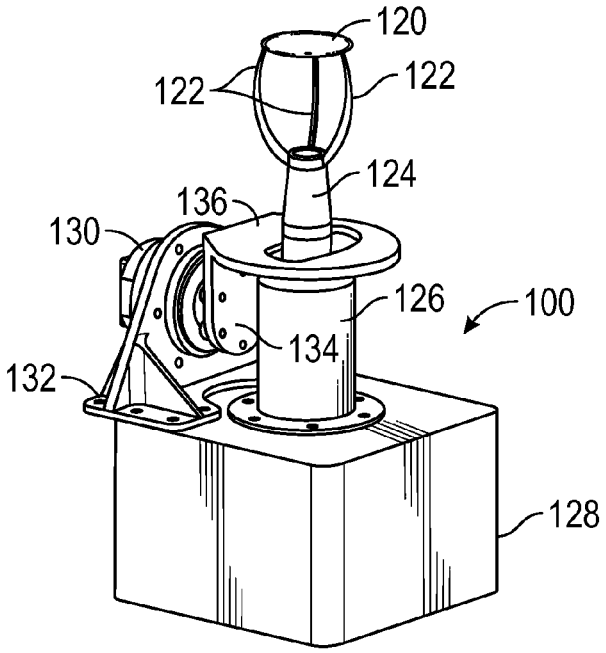

FIGS. 2 and 3 are two different perspective view illustrations of an ISL subsystem 100 which provides many advantages over traditional ISL systems. Two of the ISL subsystems 100 would be needed on a communications satellite—such as the satellite 10—where one ISL subsystem 100 is forward-looking and one ISL subsystem 100 is rearward-looking. The ISL subsystem 100 is a dual-reflector design including a main reflector 110 and a subreflector 120. The main reflector 110 includes a central opening 112 which has an elongated shape to accommodate articulation of the main reflector 110 while components situated within the central opening 112 remain stationary. The main reflector 110 has been removed in FIG. 3 for improved clarity in viewing other components. The main reflector 110 has a super-elliptical shape, the advantages of which will be discussed below.

The subreflector 120 is mounted in a fixed position via three struts 122. The struts 122 are attached, at an end opposite the subreflector 120, to a feed cone 124. The feed cone 124 is mounted to an electronics housing 126, which is mounted in turn to an ISL housing 128. The ISL housing 128 is fixed to or incorporated into a satellite main body or chassis (not shown). In simple terms, the ISL subsystem 100 operates by preparing an ISL feed signal using circuitry in the electronics housing 126, and providing the ISL feed signal to a horn (not shown) which is located inside the feed cone 124; the horn directs the ISL feed signal onto the back of the subreflector 120, which reflects and disperses the ISL feed signal onto the face of the main reflector 110, which reflects the ISL feed signal in essentially parallel-ray waves to the remote satellite.

In the ISL subsystem 100, only the main reflector 110 is steerable. As mentioned above, the subreflector 120 is fixed or stationary with respect to the ISL housing 128 and therefore the parent satellite—such as the satellite 10. Furthermore, the main reflector 110 is steerable only about a single axis, where the shape of the main reflector 110 is designed to provide a beam which is broad enough to avoid the need for main reflector steering about a second axis. The single-axis gimbal mount of the main reflector 110 not only eliminates the need for a second motor (with its associated cost and mass), but also enables the use of a simple single-axis mount instead of a complex and less precise dual-axis gimbal.

A motor 130 is mounted to a motor mount 132, which in turn is attached to the ISL housing 128. The motor 130 may be a servo motor or any type of motor which can be used to precisely establish a rotational position about its axis of rotation. A pivot arm 134 is attached to an output shaft of the motor 130. At an opposite end of the pivot arm 134 is fixed a reflector mount disk 136, which also includes a central opening similar to the opening 112 in the main reflector 110. The main reflector 110 is attached to the reflector mount disk 136. When the motor 130 rotates the pivot arm 134 from its centered or 0° position, the main reflector 110 tilts or steers by the same angular amount. In one embodiment, the main reflector 110 can be tilted by an amount of ±6°. A controller in the ISL subsystem 100 positions the motor 130 at an angle which optimally aims the main reflector 110 in the elevation plane, directly at the leading or trailing satellite in the constellation.

Figure 4:
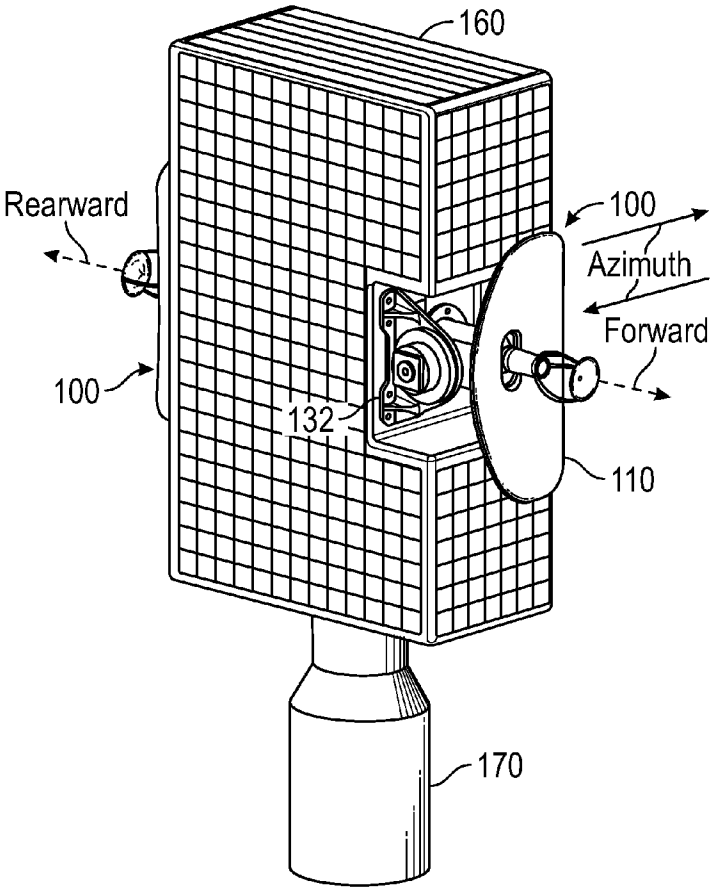
FIG. 4 is an isometric view illustration of a second embodiment of an ISL system, where two of the ISL subsystems are mounted to a chassis in a deployable boom configuration.

FIG. 4 is an isometric view illustration of a second embodiment of the ISL subsystem 100, where two of the ISL subsystems 100 are mounted to a chassis 160 in a deployable boom configuration. The chassis 160 is essentially an ISL module which is attached to the end of a boom 170, where the opposite end of the boom 170 is mounted to a main body of a satellite (not shown). In the deployable boom configuration of FIG. 4, one ISL subsystem 100 is aimed toward the leading satellite, and the other ISL subsystem 100 is aimed toward the trailing satellite. The deployable boom configuration of FIG. 4 offers the advantage of positioning the ISL subsystems 100 away from thrusters and other components on the body of the satellite, where the ISL subsystems 100 have a clear line of sight to the leading and trailing satellites in the constellation. Another advantage of the boom configuration is that inter-satellite communications remain operational during satellite yaw maneuvers.

In the deployable boom configuration shown in FIG. 4, the motor mounts 132 are attached directly to the chassis 160 rather than to the ISL housing 128 as in FIGS. 2 and 3. All other components of the ISL subsystem 100 are the same in FIGS. 2-3 and 4. FIG. 4 is also helpful in explaining the directional convention for the ISL subsystem 100. As discussed previously, the reflectors of the ISL subsystems 100 are aimed toward the leading and trailing satellites. This is shown by the arrows labeled "Forward" and "Rearward". The elevation direction—toward earth and away from earth—are shown as down and up, respectively, in FIG. 4. This elevation direction is the direction in which the main reflector 110 is steerable. The azimuth—or side to side—direction is also shown in FIG. 4. No steering of the main reflector 110 is needed in the azimuth direction, as the beam from the main reflector 110 is broad enough to provide acceptably small signal losses with no steering.

The ISL subsystem 100—whether attached directly to a satellite body in the configuration of FIGS. 1 and 2-3, or in the deployable boom configuration of FIG. 4—offers many advantages over traditional ISL systems. One significant advantage comes from using a single-axis gimbal instead of dual-axis. Traditional ISL systems use a round main reflector (antenna) shape, which must be precisely positioned in both the elevation and azimuth directions in order to maintain the required signal strength with the remote satellite. In contrast, the ISL subsystem 100 includes a single-axis gimbal for tilting the main reflector 110 about only a single axis, thus enabling the positioning mechanism of the ISL subsystem 100 to be made much smaller, lighter, less expensive and more reliable. The importance of the improvements in size, mass and reliability is magnified tremendously in satellites, due to the cost of launching the satellites into orbit and the inability to repair any problems that may occur. The single axis gimbal feature of the ISL subsystem 100 is made possible by the super-elliptical shape of the main reflector 110, discussed below.

Another advantage of the ISL subsystem 100 is that only the main reflector 110 is steered. As discussed above, the subreflector 120 is fixed relative to the host satellite, as are the horn (shown in later figure), the feed cone 124 and the circuitry inside the electronics housing 126 which prepares the ISL feed signal. Mounting the subreflector 120, the horn, the feed cone 124 and other components in a fixed position on the satellite provides additional simplification, cost reduction and mass reduction relative to traditional ISL systems which steer these components. Furthermore, because all of the feed circuitry, the horn and the subreflector 120 are stationary, no coils of wire or cable need to be routed around the motor 130 and along the pivot arm 134. The elimination of such wire coils further reduces cost and mass, and further increases simplicity and reliability.

Figure 5:
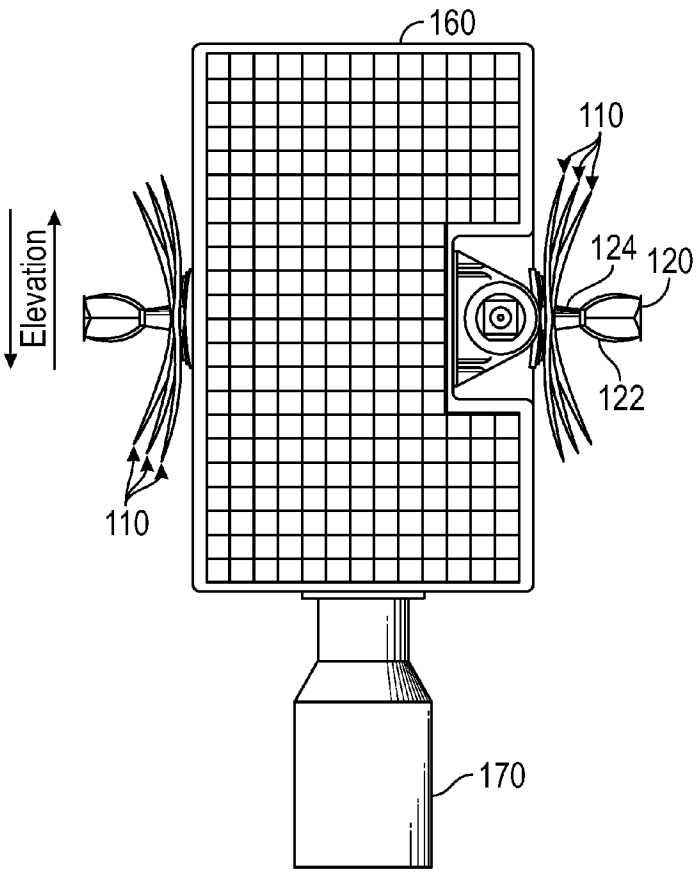
FIG. 5 is a side view illustration of the deployable boom configuration including two of the ISL subsystems, where the main reflectors are shown in the design position and at each extreme of elevation steer angle.

FIG. 5 is a side view illustration of the deployable boom configuration including two of the ISL subsystems 100, where the main reflectors 110 are shown in the design position (no steer) and at each extreme of elevation steer angle (±6°). It can be seen in FIG. 5 that only the main reflectors 110 are articulated; the subreflectors 120, the struts 122 and the feed cones 124 do not move relative to the chassis 160.

In order to achieve the benefits of the ISL subsystem 100 described above, the main reflector 110 must be designed to simultaneously meet several design requirements—including size constraints, overall transmit/receive efficiency, and directional performance in both the elevation and azimuth directions. A super-elliptical aperture shape for the main reflector 110 has been designed to meet all of these requirements.

A super-ellipse is a geometric figure mathematically defined in a Cartesian coordinate system as the set of all points (x, y) with:

$$\left(\frac{x}{a}\right)^n + \left(\frac{y}{b}\right)^n = 1 \tag{1}$$

Where a, b, and n are positive numbers.

The formula of Equation (1) defines a closed curve contained in the rectangle bounded by $-a \le x \le +a$ and $-b \le y \le +b$. The parameters a and b are called the semi-diameters of the curve. When n is between 0 and 1, the super-ellipse looks like a four-armed star with concave (inward-curved) sides. When n is equal to 1, the curve is a rhombus with corners (±a, 0) and (0, ±b). When n is between 1 and 2, the curve looks like a rhombus with those same corners but with convex (outward-curved) sides. These lower-order super-ellipse shapes, with n less than 2, are of no interest from an antenna reflector design standpoint.

When n is equal to 2, the super-ellipse curve is an ordinary ellipse (in particular, a circle if a=b). When n is greater than 2, the curve looks superficially like a rectangle with rounded corners.

Figure 6:
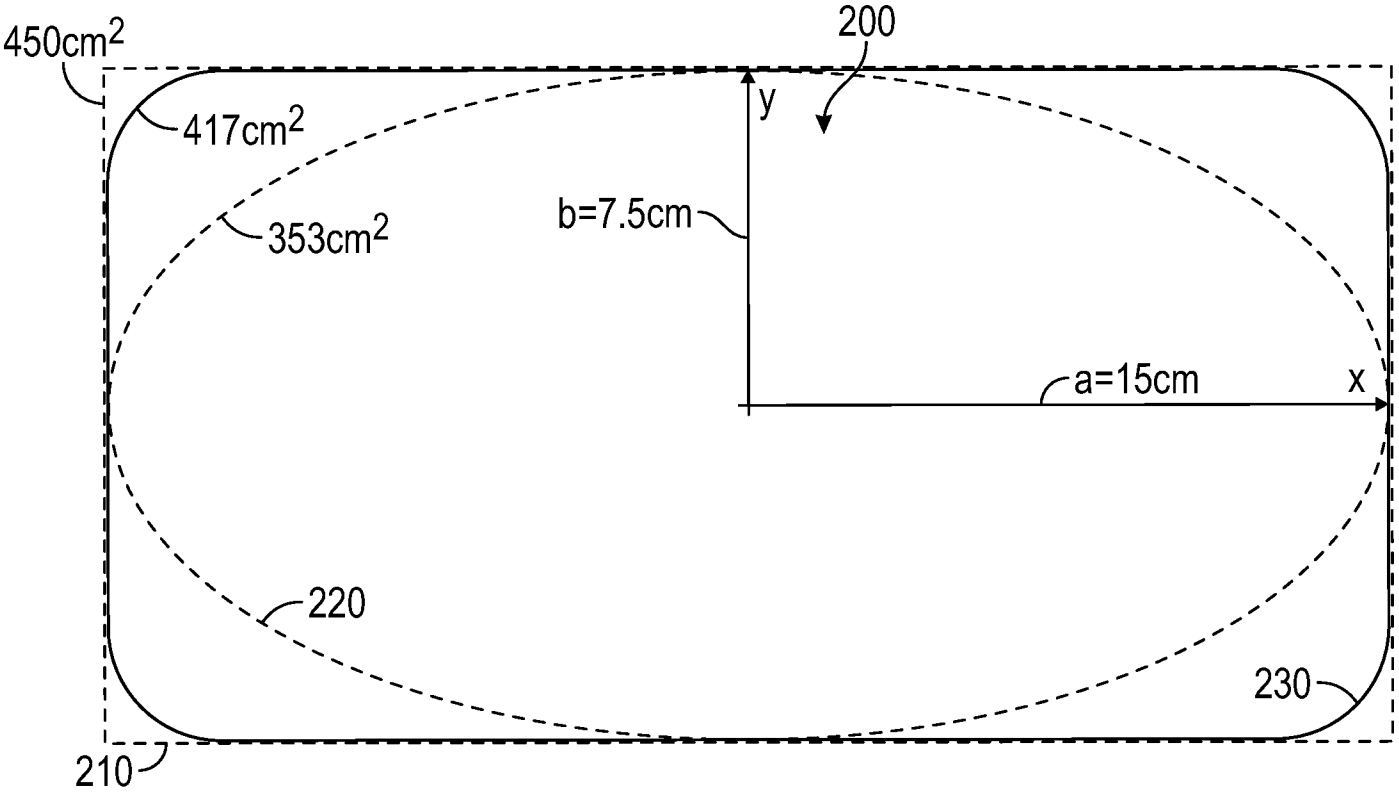
FIG. 6 is an illustration of a Cartesian coordinate system including various super-elliptical shapes, including a shape used in a preferred design embodiment of the main reflector of the ISL subsystem.

FIG. 6 is an illustration of a Cartesian coordinate system 200 including various super-elliptical shapes, including a profile shape used in a preferred design embodiment of the main reflector 110. The Cartesian coordinate system 200 includes x and y axes as shown. Rectangle 210 defines the outer boundary of all super-ellipses with semi-diameters a and b. As discussed above, the rectangle 210 is essentially a super-ellipse with a very large value of n. Ellipse 220 is a super-ellipse with n equal to 2. Super-ellipse 230 has a value of n equal to 4.

For all of the shapes shown on FIG. 6, the x-direction semi-diameter (a) has a value of 15 cm, and the y-direction semi-diameter (b) has a value of 7.5 cm. The selection of these size parameters will be discussed below. Simple geometry reveals that the rectangle 210 has an area of 450 $cm^2$. The ellipse 220 has an area of about 353 $cm^2$. The super-ellipse 230—with a value of n equal to 4—has an area of about 417 $cm^2$, which is much closer to the area of the rectangle 210 than the area of the ellipse 220.

Figure 7:
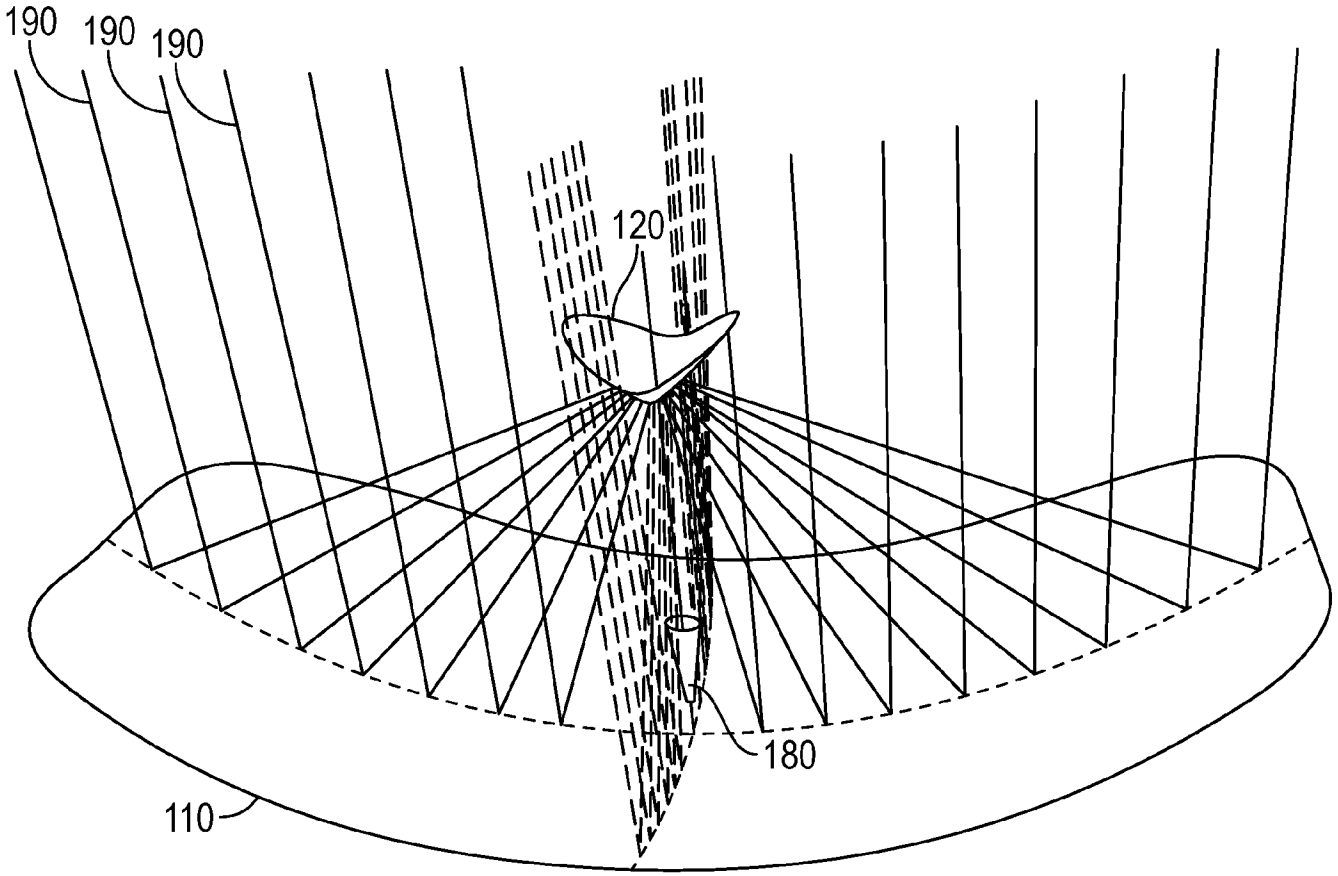
FIG. 7 is an illustration of geometrical optics ray tracing of the ISL subsystem through the main reflector, a subreflector and a horn, where the main reflector has the shape of one of the preferred super-ellipse of FIG. 6, wrapped into a concave configuration.

FIG. 7 is an illustration of geometrical optics ray tracing of the ISL subsystem through the main reflector 110, the subreflector 120 and a horn 180, where the main reflector 110 has the profile shape of the super-ellipse 230 wrapped into a concave configuration. In FIG. 7, it can be seen how inter-satellite transmission signals 190 are emitted from the horn 180 and directed onto the near side of the subreflector 120, where the signals 190 are reflected and scattered back onto the main reflector 110 which reflects the signals toward the remote satellite. Inter-satellite transmission signals 190 which are received by the ISL subsystem 100 follow the same geometric routing as the signals 190 which are being transmitted. That is, received signals 190 approach the ISL subsystem 100 from the remote satellite, strike the main reflector 110 and are directed onto the near side of the subreflector 120, where they are reflected and focused down into the horn 180.

The following discussion provides more insight into how the size and shape of the main reflector 110 have been optimized to meet the performance and packaging requirements discussed previously. The first part of this discussion relates to the overall size or "footprint" of the main reflector 110. As discussed at length above, an objective of the ISL subsystem 100 is to use only a single-axis gimbal and steer the main reflector 110 in only the elevation plane. With no antenna steering in the azimuth plane, azimuth alignment is entirely dependent upon the actual locations of the satellites in the constellation, which can typically be maintained within a tolerance of ±0.5°. In order to maintain the desired signal strength, it is necessary to limit signal gain loss due to a pointing error of ±0.5° in the azimuth direction to less than 1.0 dB.

The main reflector 110 has been designed with a width in the azimuth direction (the narrow dimension of the main reflector 110, which corresponds to two times the semi-diameter b of FIG. 6) of 15 cm. The 15 cm width in the azimuth direction results in a gain loss due to 0.5° pointing error of 0.90 dB, which meets the requirement. Furthermore, the 15 cm width in the azimuth direction provides an antenna size ratio of 35.5 wavelengths at the highest operating frequency, where this ratio is also within a preferred range.

With the width of the main reflector 110 in the azimuth direction established at 15 cm, the size of the main reflector 110 in the elevation direction (height) has been established at 30 cm, which maximizes aperture size without exceeding a 2:1 aspect ratio. The 30 cm height corresponds to two times the semi-diameter a of FIG. 6. The larger size of the main reflector 110 in the elevation direction produces a narrower beam, which can be precisely steered.

With the overall size of the main reflector 110 established as discussed above, it is then necessary to design the shape of the aperture. For a given footprint size of the main reflector 110 (in this example, 30×15 cm; that is, a=15 cm, b=7.5 cm), the rectangle 210 has the largest possible surface area and therefore provides a theoretical maximum signal transmission capability. Therefore, the main reflector 110 in the shape of the rectangle 210 can be considered to have a transmission loss of 0.0 dB. Rectangular or square apertures are not desirable, however, due to strong diffraction from the four corners that impacts the radiation patterns. Smooth edges—such as those of the ellipse 220 or the super-ellipse 230—are preferred for the shape of the main reflector 110. Analysis and testing show that the main reflector 110, if made in the shape of the ellipse 220, has a transmission loss of 1.05 dB relative to the rectangle 210. This loss is due to the significantly lower surface area of the ellipse 220 than the rectangle 210, as shown on FIG. 6. On the other hand, if made in the shape of the super-ellipse 230, the main reflector 110 has a transmission loss of only 0.33 dB, which is considerably less loss than exhibited by the ellipse 220.

As a result of all of the considerations discussed above, the super-ellipse 230 has been chosen as the shape of the main reflector 110, with a size of 30 cm (height in elevation direction) by 15 cm (width in azimuth direction). This shape and size of the main reflector 110 enables the ISL subsystem 100 to include only single-axis main reflector steering and still meet the performance and packaging requirements discussed above.

Figure 8:
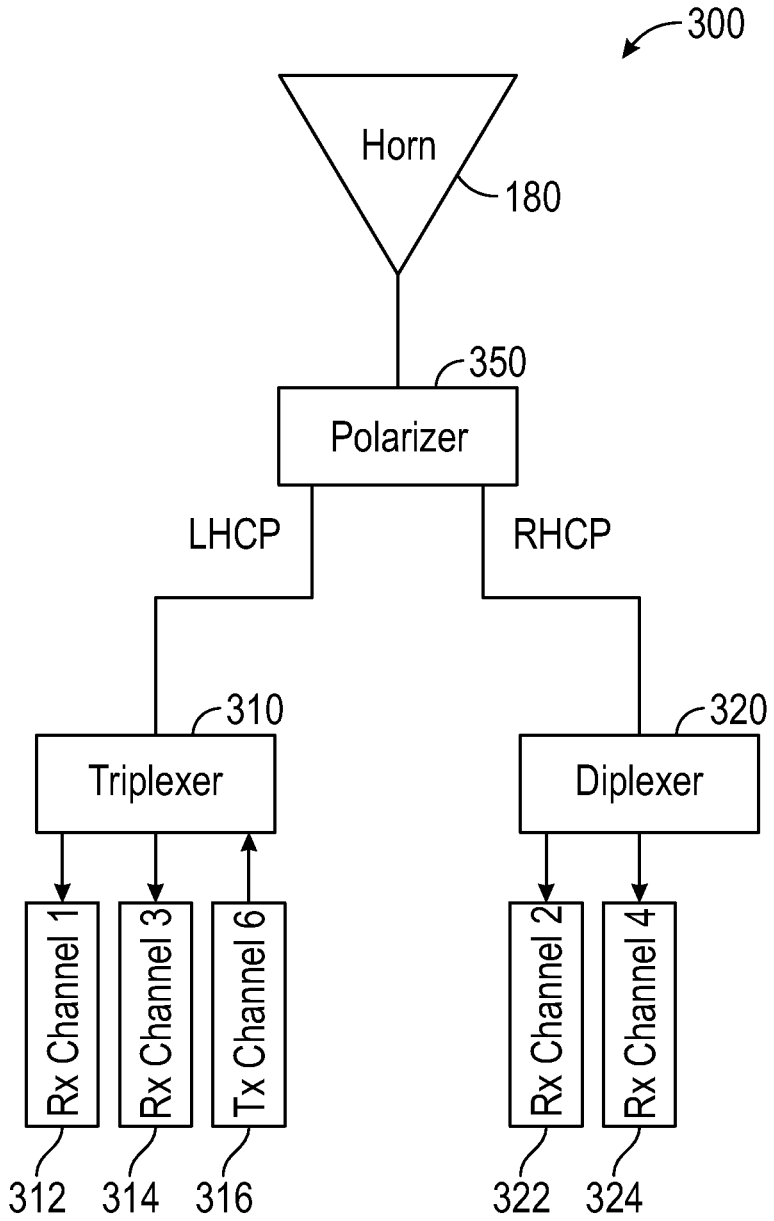
FIG. 8 is a block diagram of inter-satellite link feed circuitry used in the ISL subsystem of FIGS. 2-5.

FIG. 8 is a block diagram of an inter-satellite link feed circuit 300 used in the ISL subsystem 100 of FIGS. 2-5. Because only the main reflector 110 is steered in the ISL subsystem 100, the subreflector 120, the horn 180 and the feed circuit 300 all remain stationary, resulting in a significant cost and mass reduction and a significant reliability increase compared to traditional ISL systems. In the ISL subsystem 100, the feed circuit 300 can be located inside of the electronics housing 126.

The ISL subsystem 100 is operable in a multiplexing mode, meaning that the ISL subsystem 100 can handle multiple receive and transmit channels simultaneously. In the feed circuit 300, a triplexer 310 handles a first receive channel 312, a third receive channel 314 and a transmit channel 316. Similarly, a diplexer 320 handles a second receive channel 322 and a fourth receive channel 324. The preparation of a signal to be transmitted via the transmit channel 316, and the processing of the signals received via the receive channels 312/314/322/324, are handled by other processors outside scope of the disclosed ISL subsystem 100.

In one embodiment of a multiplexing frequency plan, the four receive channels 312/314/322/324 each span a frequency range of 2.0 gigahertz (GHz) with no gap between frequency bands, and the transmit channel 316 also spans a frequency range of 2.0 GHz but with a gap of 1.5 GHz above the receive channel 324. Specifically, the first receive channel 312 has a frequency band of 59.5-61.5 GHz, the second receive channel 322 has a frequency band of 61.5-63.5 GHz, the third receive channel 314 has a frequency band of 63.5-65.5 GHz, the fourth receive channel 324 has a frequency band of 65.5-67.5 GHz, and the transmit channel 316 has a frequency band of 69.0-71.0 GHz. Other frequency bands and arrangements are of course also possible.

The triplexer 310 and the diplexer 320 communicate with an outermost polarizer 350 via a left hand circular polarization signal and a right hand circular polarization signal, respectively. The outermost polarizer 350 converts the linear polarizations to circular polarizations on the transmit side and converts the incident circular polarizations to linear polarizations on the receive side and is connected to the horn 180, which transmits the signals 190 onto and receives the signals 190 from the subreflector 120, as discussed previously with respect to FIG. 7. Because the horn 180 is stationary and transmits/receives signals directly to/from the subreflector 120, the feed circuit 300 can be located near the horn 180, thus minimizing front-end RF losses. Furthermore, no flexible loops of wire or cable need to be provided between the feed circuit 300 and the horn 180, because both are fixed in place. These advantages, which stem from the fact that only the main reflector 110 is steered, result in further improvements in mass, cost, complexity and reliability for the ISL subsystem 100.

The inter-satellite link communication system described above provides numerous advantages over traditional ISL systems. These advantages include the single-axis gimbal positioning of the main reflector and the stationary mounting of the subreflector, horn and feed circuitry, which in turn are enabled by the super-elliptical shape of the main reflector which meets signal strength requirements without the need for steering in the azimuth plane. This combination of features enables communication satellites to be made smaller, lighter, less expensive, less complex and more reliable—all of which are favorable for telecommunications and other companies which employ communications satellites, and ultimately for the consumer.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An inter-satellite link (ISL) subsystem for a communications satellite, said ISL subsystem comprising:

a main reflector having a super-elliptical shape and an elongated central opening;

a mounting plate fixed to a back side of the main reflector, said mounting plate also having an elongated central opening;

a single axis gimbal motor including a motor mount which mounts the motor to a chassis of the communications satellite;

a pivot arm attached at a first end to an output shaft of the motor, said pivot arm being attached at a second end to the mounting plate such that a rotation of the output shaft of the motor causes the main reflector to tilt;

a radio frequency (RF) feed circuit contained in an electronics housing, where said electronics housing is mounted to the chassis;

a feed cone mounted to the electronics housing, said feed cone having a generally tubular shape and positioned where it passes through the central openings of the main reflector and the mounting plate;

a horn in communication with the RF feed circuit, said horn sending and receiving RF signals to and from a remote satellite, where the horn is positioned inside the feed cone; and a subreflector mounted via a plurality of struts to the feed cone and centered on an axis of the feed cone, where the RF signals radiate from the horn to the subreflector to the main reflector to the remote satellite, and vice versa, and a beam of the RF signals is steered in an elevation plane only via tilting of the main reflector by the motor.

2. The ISL subsystem of claim 1 wherein the chassis is a main body of the communications satellite.

3. The ISL subsystem of claim 1 wherein the chassis is an ISL module which is deployed on a boom which is mounted to the main body of the communications satellite.

4. The ISL subsystem of claim 1 wherein the main reflector has a shape which provides a beam resulting in less than 1.0 dB of signal strength loss in a condition of a 0.5° pointing error in an azimuth plane.

5. The ISL subsystem of claim 4 wherein the main reflector has a height in the elevation plane of 30 centimeters (cm), a width in the azimuth plane of 15 cm, and a shape defining a super-ellipse with an exponent value of 4.

6. The ISL subsystem of claim 1 wherein the main reflector is steerable by ±6° in the elevation plane and is steered to eliminate misalignment in the elevation plane with the remote satellite.

7. The ISL subsystem of claim 1 wherein the RF feed circuit includes a polarizer in communication with the horn and one or more multiplexers, where a single transmit channel and a plurality of receive channels pass through the one or more multiplexers.

8. The ISL subsystem of claim 7 wherein the single transmit channel and the plurality of receive channels occupy separate frequency bands in an overall frequency range of 55-75 gigahertz (GHz).

9. The ISL subsystem of claim 1 wherein the communications satellite includes a first ISL subsystem in communication with a leading remote satellite and a second ISL subsystem in communication with a trailing remote satellite.

10. The ISL subsystem of claim 1 wherein the communications satellite and the remote satellite are part of a constellation of communications satellites in low earth orbit or medium earth orbit.

11. A satellite module comprising:

a chassis;

two inter-satellite link (ISL) subsystems, each of the ISL subsystems comprising;

a main reflector having a super-elliptical shape and an elongated central opening;

a mounting plate fixed to a back side of the main reflector, said mounting plate also having an elongated central opening;

a motor including a motor mount which mounts the motor to the chassis;

a pivot arm attached at a first end to an output shaft of the motor, said pivot arm being attached at a second end to the mounting plate such that a rotation of the output shaft of the motor causes the main reflector to tilt;

a radio frequency (RF) feed circuit contained in an electronics housing, where said electronics housing is mounted to the chassis;

a feed cone mounted to the electronics housing, said feed cone having a generally tubular shape and positioned where it passes through the central openings of the main reflector and the mounting plate;

a horn in communication with the RF feed circuit, said horn sending and receiving RF signals to and from a remote satellite, where the horn is positioned inside the feed cone; and a subreflector mounted via a plurality of struts to the feed cone and centered on an axis of the feed cone, where the RF signals radiate from the horn to the subreflector to the main reflector to the remote satellite, and vice versa, and the main reflector is steered in an elevation plane only via tilting by the motor.

12. The satellite module of claim 11 wherein the chassis is a main body of a communications satellite, the ISL subsystems communicate with a leading satellite and a trailing satellite, and the communications satellite, the leading satellite and the trailing satellite are part of a constellation of communications satellites in low earth orbit or medium earth orbit.

13. The satellite module of claim 11 wherein the chassis is an ISL module which is deployed on a boom which is mounted to a main body of a communications satellite, the ISL subsystems communicate with a leading satellite and a trailing satellite, and the communications satellite, the leading satellite and the trailing satellite are part of a constellation of communications satellites in low earth orbit or medium earth orbit.

14. The ISL subsystem of claim 11 wherein each of the main reflectors has a height in the elevation plane of 30 centimeters (cm), a width in an azimuth plane of 15 cm, and a shape defining a super-ellipse with an exponent value of 4, and each of the main reflectors provides a beam resulting in less than 1.0 dB of signal strength loss in a condition of a 0.5° pointing error in the azimuth plane.

15. An inter-satellite link (ISL) subsystem for a communications satellite, said ISL subsystem comprising:

a main reflector having a super-elliptical shape;

a motor mounted to a chassis of the communications satellite, said motor being coupled to the main reflector such that a rotation of an output shaft of the motor causes the main reflector to tilt;

a horn in communication with a radio frequency (RF) feed circuit, said horn sending and receiving RF signals to and from a remote satellite, where the horn is mounted in a fixed location on the chassis; and a subreflector mounted via a plurality of struts in a fixed location on the chassis, where the RF signals radiate from the horn to the subreflector to the main reflector to the remote satellite, and vice versa, and the main reflector is steered in an elevation plane only via tilting by the motor.

16. The ISL subsystem of claim 15 wherein the chassis is a main body of a communications satellite, and the ISL subsystem communicates with the remote satellite which, along with the communications satellite, is part of a constellation of communications satellites in low earth orbit or medium earth orbit.

17. The ISL subsystem of claim 15 wherein the chassis is an ISL module which is deployed on a boom which is mounted to a main body of a communications satellite, and the ISL subsystem communicates with the remote satellite which, along with the communications satellite, is part of a constellation of communications satellites in low earth orbit or medium earth orbit.

18. The ISL subsystem of claim 15 wherein the main reflector has a height in the elevation plane of 30 centimeters (cm), a width in an azimuth plane of 15 cm, and a shape defining a super-ellipse with an exponent value of 4, and the main reflector provides a beam resulting in less than 1.0 dB of signal strength loss in a condition of a 0.5° pointing error in the azimuth plane.

19. The ISL subsystem of claim 15 wherein the main reflector is steerable by ±6° in the elevation plane and is steered to eliminate misalignment in the elevation plane with the remote satellite.

20. The ISL subsystem of claim 15 wherein the RF feed circuit includes a polarizer in communication with the horn and one or more multiplexers, where a single transmit channel and a plurality of receive channels pass through the one or more multiplexers, and the single transmit channel and the plurality of receive channels occupy separate frequency bands in an overall frequency range of 55-75 gigahertz (GHz).

* * * * *